US011420851B2

(12) United States Patent
Gevaudant et al.

(10) Patent No.: US 11,420,851 B2
(45) Date of Patent: Aug. 23, 2022

(54) TOWER CRANE WITH AUTOMATIC FOLDING AND UNFOLDING STANCHION

(71) Applicant: MANITOWOC CRANE GROUP FRANCE, Dardilly (FR)

(72) Inventors: Olivier Gevaudant, Marcy l+3 Etoile (FR); Yves Alloin, St Germain en Brionnais (FR); Vincent Veillerot, Tassin la Demi Lune (FR); Simon Grimaud, Lyons (FR); Sylvain Cuillerier, Regnier Durette (FR)

(73) Assignee: Manitowoc Crane Group France, Dardilly (FR)

( * ) Notice: Subject to any disclaimer, the term of this patent is extended or adjusted under 35 U.S.C. 154(b) by 87 days.

(21) Appl. No.: 17/085,832

(22) Filed: Oct. 30, 2020

(65) Prior Publication Data

US 2021/0130141 A1 May 6, 2021

(30) Foreign Application Priority Data

Oct. 31, 2019 (FR) ..... 1912237

(51) Int. Cl.
*B66C 23/34* (2006.01)
*B66C 23/16* (2006.01)
(Continued)

(52) U.S. Cl.
CPC ..... *B66C 23/344* (2013.01); *B66C 13/18* (2013.01); *B66C 23/16* (2013.01); *B66C 23/68* (2013.01)

(58) Field of Classification Search
CPC ..... B66C 23/16; B66C 23/34; B66C 23/344; B66C 23/42; B66C 23/68
See application file for complete search history.

(56) References Cited

U.S. PATENT DOCUMENTS 5,016,768 A * 5/1991 Kennard, Jr. ..... B66C 23/344 212/262
6,276,541 B1 * 8/2001 Gevaudant ..... B66C 23/26 212/300
2017/0183203 A1 * 6/2017 Verchere ..... B66C 23/74

FOREIGN PATENT DOCUMENTS

CH 499455 A5 11/1970
DE 1209262 B 1/1966
(Continued)

OTHER PUBLICATIONS

CH 499455A Machine Translation (Year: 1970).*
CH 499455A Machine Translation. Previously attached. See NPL of Apr. 13, 2022. (Year: 1970).*

*Primary Examiner* — Michael R Mansen
*Assistant Examiner* — Juan J Campos, Jr.
(74) *Attorney, Agent, or Firm* — Cook Alex Ltd.

(57) ABSTRACT

A tower crane configured to fold and unfold between a working configuration and a transport configuration includes a boom hinged in rotation relative to a mast about a main axis of rotation. The tower crane includes a rear retainer fastened to a frame supporting the mast and to a stanchion. The stanchion extends the boom rearwardly of the main axis of rotation and is displaceable relative to the boom between a working position and a transport position. The tower crane further includes a lifting cable connected to a winding device exerting, on the lifting cable, a tension force applied on stanchion by a return system configured to cooperate with the lifting cable, so as to cause displacement of said stanchion from the working position to the transport position.

16 Claims, 5 Drawing Sheets

(51) Int. Cl.
*B66C 13/18* (2006.01)
*B66C 23/68* (2006.01)

(56) References Cited

FOREIGN PATENT DOCUMENTS

| | | |
|---|---|---|
| EP | 1364906 | 11/2003 |
| EP | 3184481 | 6/2017 |

* cited by examiner

[Fig. 1]
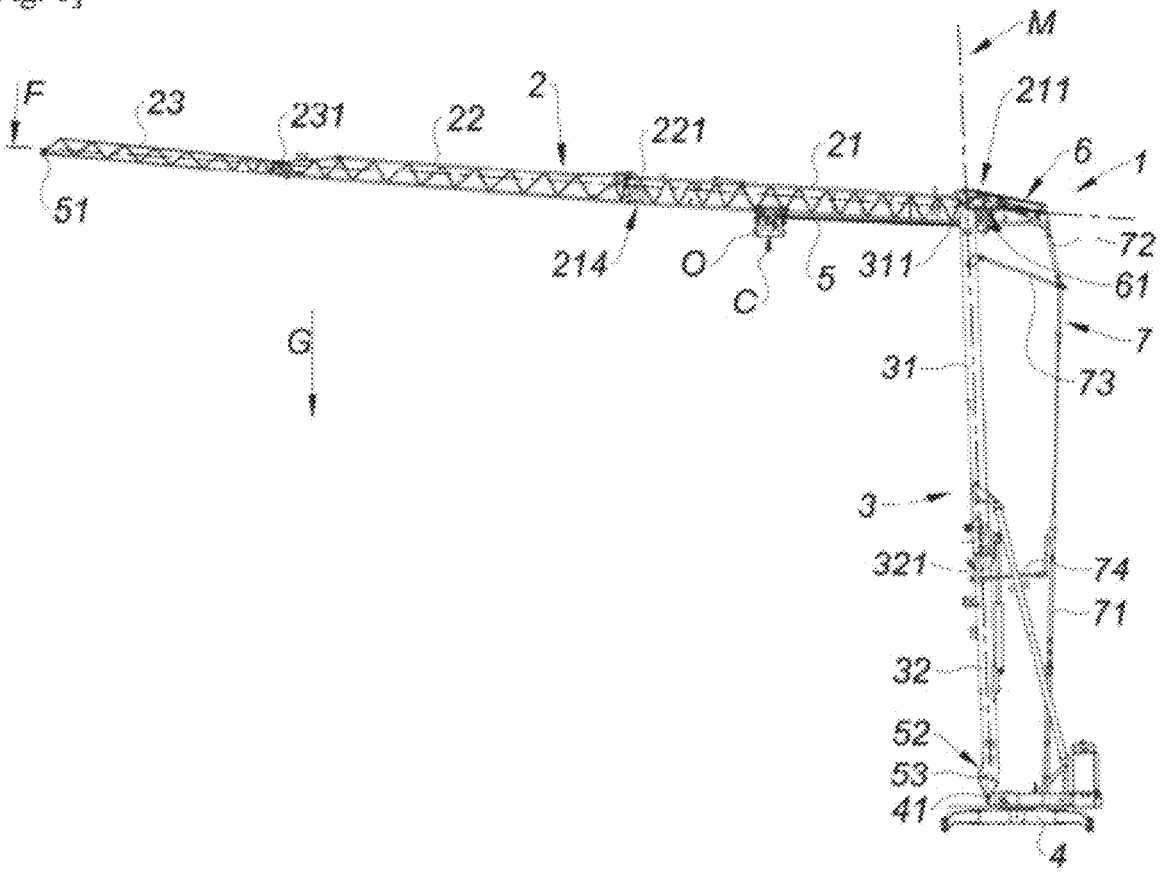
[Fig. 2]
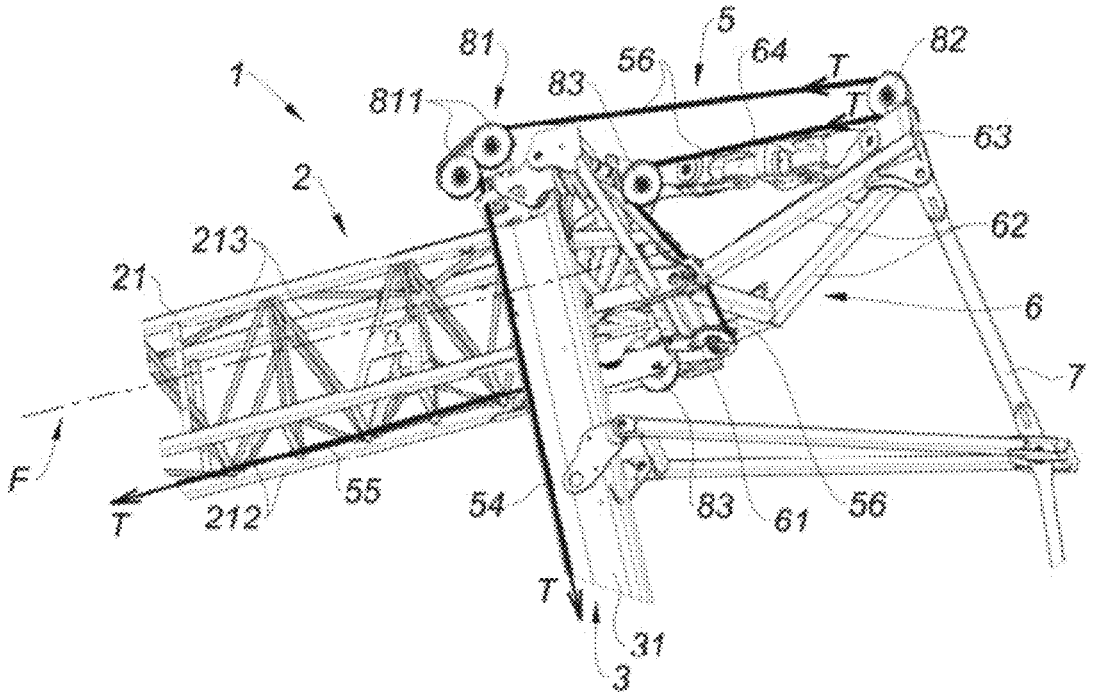

[Fig. 3]
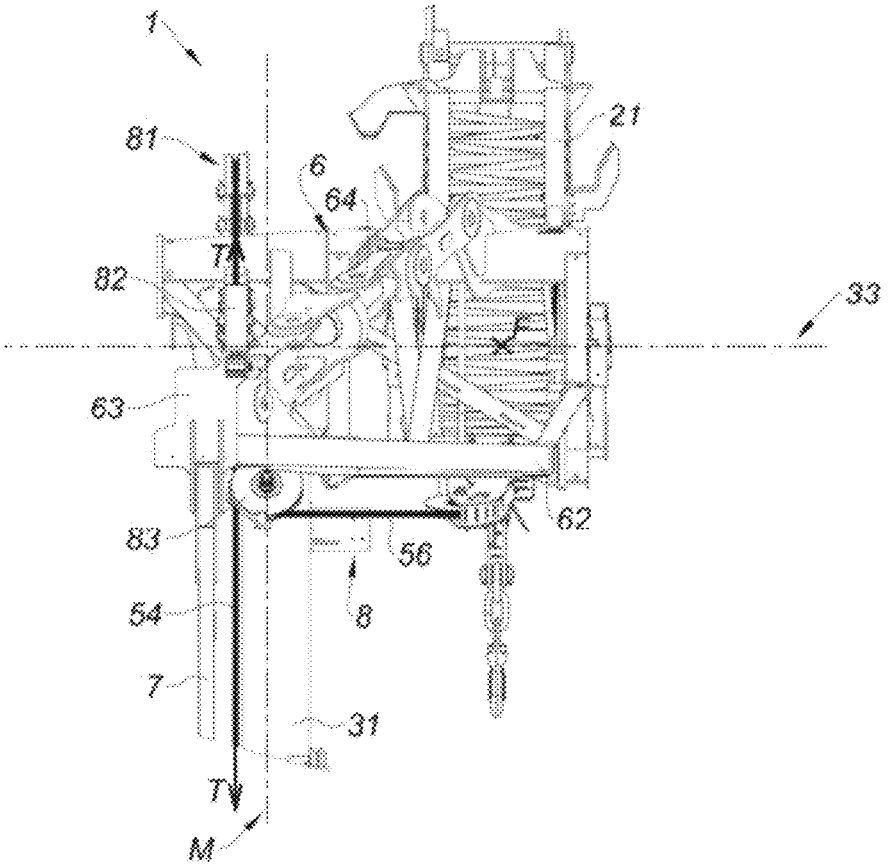
[Fig. 4]
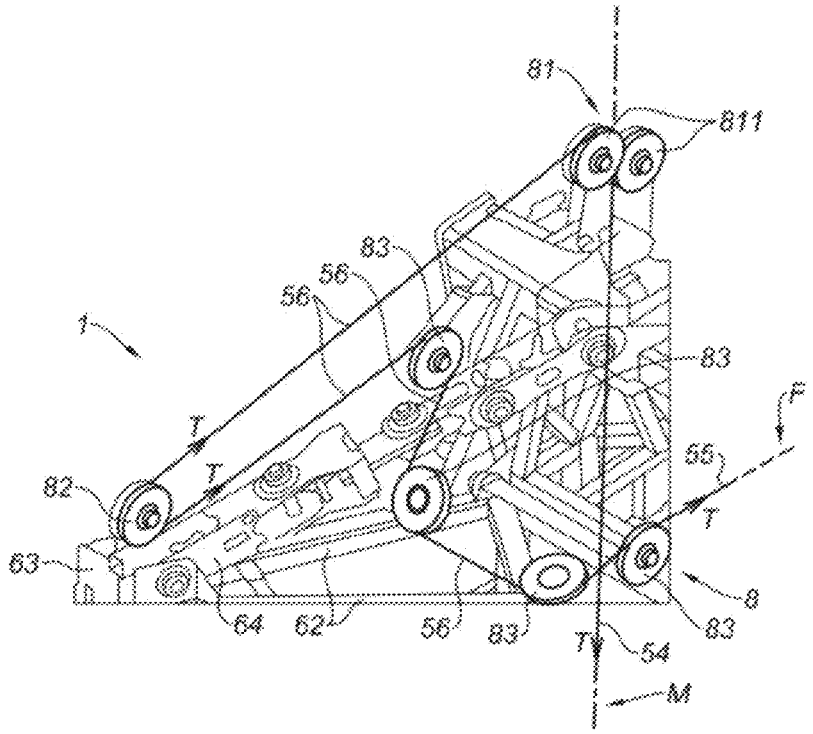

[Fig. 5]
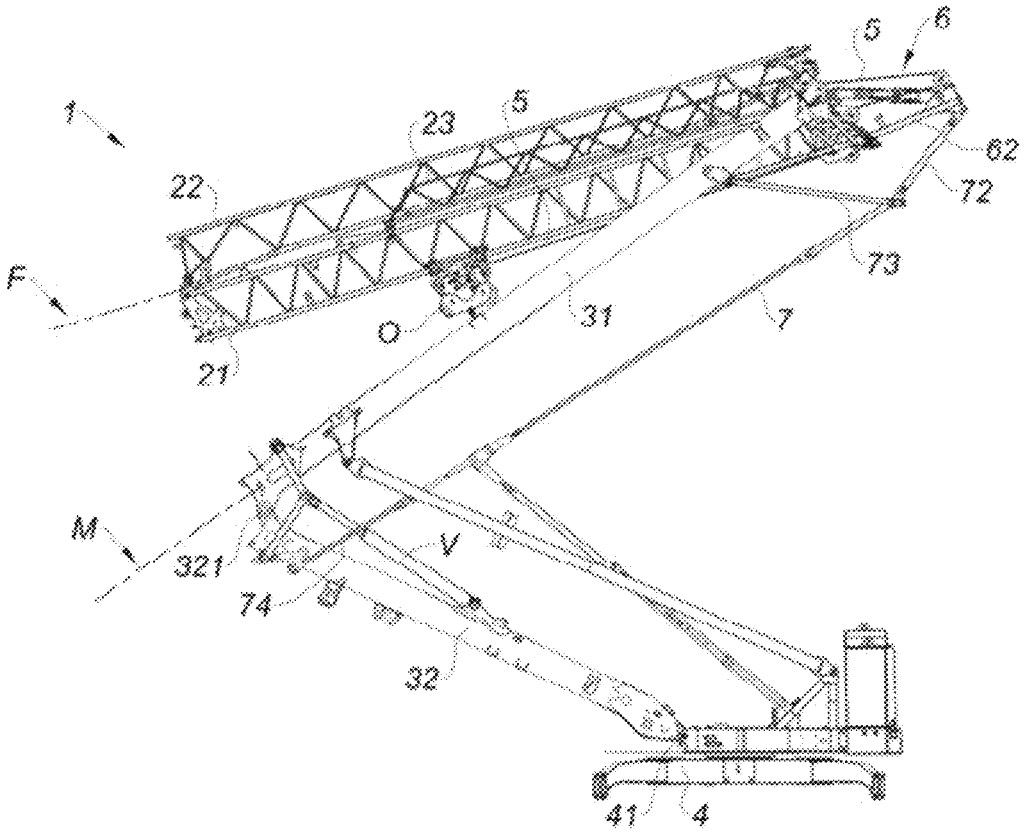
[Fig. 6]
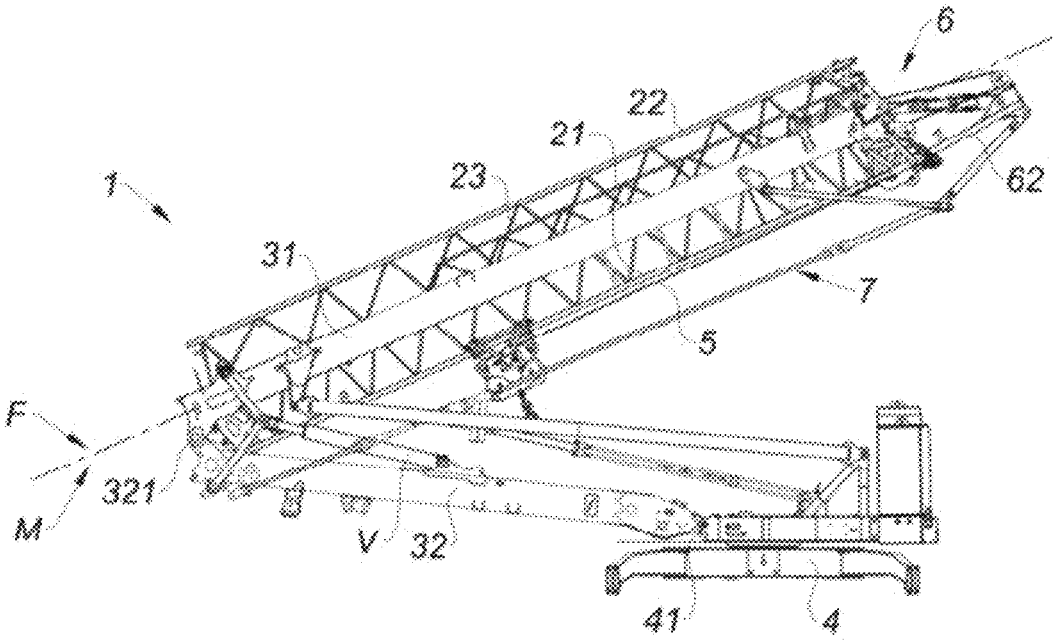

[Fig. 7]
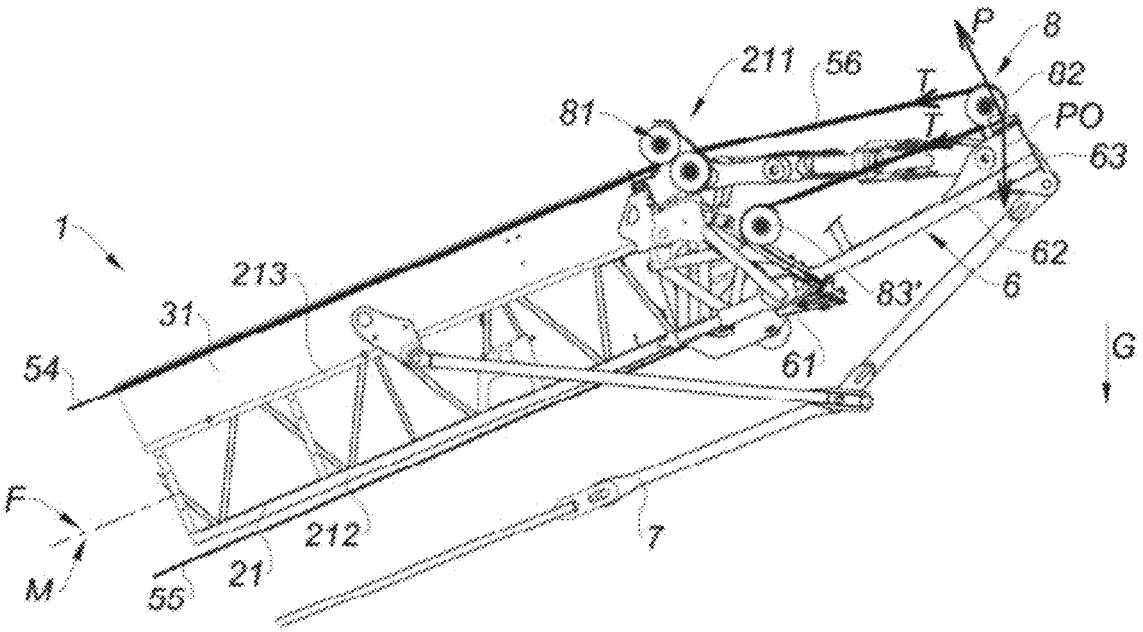
[Fig. 8]
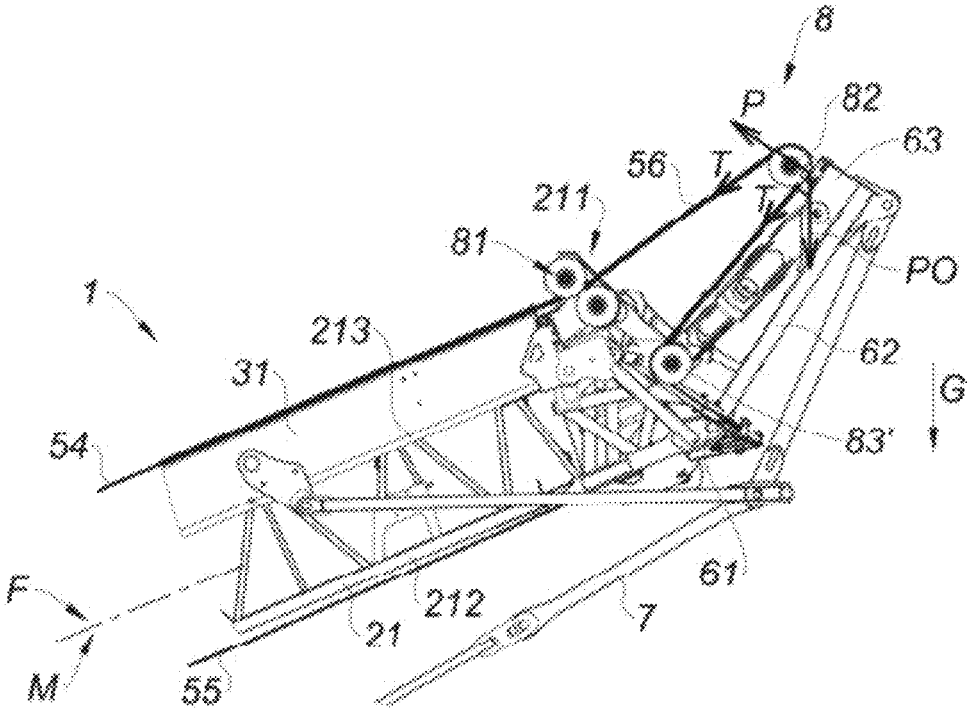

[Fig. 9]
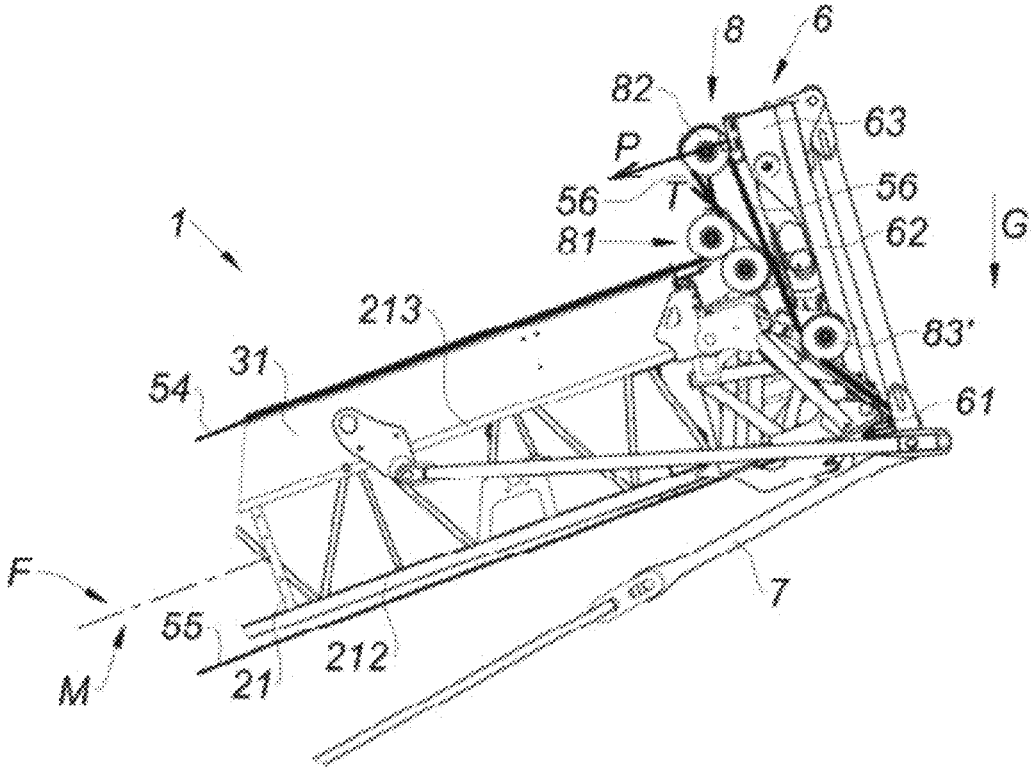
[Fig. 10]
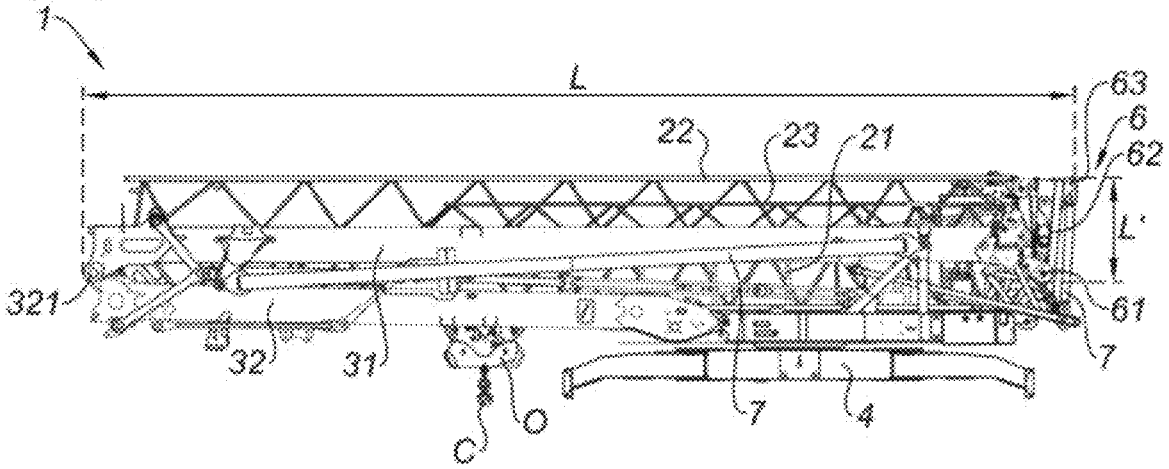

TOWER CRANE WITH AUTOMATIC FOLDING AND UNFOLDING STANCHION

FIELD

The present invention concerns an automatic folding and unfolding tower crane, including at least one stanchion whose folding and unfolding are also automatic.

It also relates to a method of folding and unfolding such a tower crane.

BACKGROUND

In the field of tower cranes, it is known to use tower cranes, including a boom connected to a mast secured to a frame disposed on the ground, which can be unfolded and folded between:

a working configuration, in which the mast is substantially vertical (that is to say, extending in a direction parallel to the force of earth's gravity) and the boom may have an angle relative to said mast comprised between 0° and 45°, generally close to 0° and the boom then being substantially horizontal, the cranes then being adapted to hoist and displace loads; and a transport configuration, in which the mast and the boom are folded against each other, so as to occupy a reduced volume and be more easily transportable.

For this purpose, said mast and said boom may include several segments hinged to each other and adapted to be folded over each other, so as to make such a tower crane even more compact in its transport configuration.

Such tower cranes also include a lifting cable, extending along the mast and along the boom, connected to a block to which a load to be hoisted is hooked: by winding or unwinding this lifting cable, for example at by means of a lifting winch secured to the frame or by means of a lower end of the mast, it is thus possible to displace said load in the vertical direction.

In a known manner, the boom usually has a stanchion (also sometimes called «counter-boom» disposed at one of the ends thereof, such that the boom is extended, when said boom is in its working position, by said stanchion rearwardly from its point of connection with the top of the mast.

This stanchion is also connected to a rear retainer, which may consist of several hinged tie rods or cables, extending substantially parallel to the mast and connecting said stanchion to the frame: this rear retainer thus allows, in the working configuration of the tower crane, to stabilize the position of the boom at the top of the mast and, in some cases, to adjust its inclination relative to the vertical.

Moreover, this rear retainer allows the automatic folding and unfolding of such a tower crane, the unfolding of the mast (under the effect of a dedicated actuator) exerting a tension force in the rear retainer causing a deployment of the boom relative to the mast, via the stanchion.

In order to make said tower crane even more compact and simple to transport in its transport configuration, the stanchion is also foldable and unfoldable between a working position, in which it extends in the extension of the boom, and a position of transport, in which it is folded in the direction of the same boom.

It is therefore necessary to provide, in such a tower crane, a specific device allowing folding and unfolding the stanchion, the nature of which may vary depending on the different types of cranes and the respective folding and unfolding methods thereof.

For example, the document FR2834505 describes a tower crane whose stanchion extends, when said tower crane is in its working configuration, obliquely with respect to the boom and above it.

When folding this crane, the boom is made to be inclined vertically and towards the ground, causing the stanchion to be automatically folded back on the upper portion of the boom, under the effect of its own weight.

However, this method for folding the stanchion is only applicable to such tower cranes in which the stanchion extends significantly above the boom in the working configuration, and also has the drawback of requiring a preliminary step of partial unfolding of the boom when unfolding these tower cranes in order to allow unfolding the stanchion: the unfolding method is therefore made more complex, thus increasing the risk of errors which can damage such tower cranes.

The document EP3184481 for its part describes a tower crane whose stanchion has (in the working configuration of the tower crane) a slight inclination relative to the boom and a reduced length, so that said stanchion can be folded into a vertical transport position, against an end portion of the boom.

This crane also includes a telescopic mast, having two mast segments which can slide one inside the other in the vertical direction: when folding this crane, the boom is made to be inclined vertically and towards the ground when de-telescoping the mast, causing the stanchion to be automatically folded back on an end portion of the boom, under the effect of its own weight.

Similarly to the previously mentioned tower crane, this method for folding the stanchion has the drawback of being limited to tower cranes including a telescopic mast.

In the case of tower cranes whose stanchion has (in the working configuration of the tower crane) a slight inclination with respect to the boom but not including a telescopic mast, it is not possible to carry out a folding of the stanchion by exploiting the force of gravity, using the stanchion's own weight.

Indeed, in these tower cranes, the displacement of the stanchion towards its transport position is carried out while the boom and the mast form an angle of about 45° with the horizontal direction: the weight of the stanchion and the rear retainer tends then to oppose the folding of this stanchion.

In order to solve this problem, the document EP1364906 describes the use of a system including gas cylinders disposed in the boom allowing folding back the stanchion against said boom, in its transport position.

However, this principle requires more space requirement inside the boom, in order to allow a more significant travel of the connecting rod assembly controlled by the gas cylinders and thus reduce the efforts required to displace the stanchion.

In the case where the space requirement available in the boom is smaller, it is then necessary to increase the number of gas struts, thus making the system more complex and more expensive.

In particular, due to bad weather and difficult site conditions to which these gas cylinders are exposed, this solution does not guarantee an unfolding or a folding of the stanchion reliable over time, thus being able to cause a risk of deterioration to the tower crane, for example in the case of non-unfolding of the stanchion when unfolding the tower crane.

Moreover, it could be possible to replace the gas cylinders of the previous system by hydraulic cylinders or any other remotely controlled actuator, but these would also prove to be complex to drive, would require changing the overall architecture of the crane in order to integrate sensors therein allowing triggering the folding or unfolding movements of the stanchion at the desired time and would not constitute an economical solution.

SUMMARY

The present invention thus aims at solving all or part of the aforementioned drawbacks by proposing a tower crane in which the folding and unfolding of the stanchion are carried out automatically, in a simple and reliable manner.

Another object of the invention is to propose a tower crane allowing accurately monitoring the folding or unfolding speed of the stanchion.

Yet another object of the invention is to propose an adapted tower crane which may be of variable type and/or capacity, in particular a tower crane which may be of high or low capacity and may or may not include a telescopic mast.

Finally, yet another object of the invention is to propose a tower crane whose method for folding or unfolding the stanchion involves elements which are already present in widespread tower cranes of the state of the art and requiring only a modest change in their architecture.

To this end, it proposes a tower crane, of the foldable and unfoldable type between a working configuration and a transport configuration, having a boom designed to be hinged in rotation relative to a mast about a main axis of rotation, said tower crane including a rear retainer provided to be fastened to a frame supporting said mast and to a stanchion, said stanchion being provided to extend said boom rearwardly of said main axis of rotation and designed to be displaceable relative to said boom between a working position and a transport position, said tower crane being characterized in that it includes a lifting cable provided to be connected to a winding device designed to exert, on said lifting cable, a tension force, said tension force being applied on said stanchion by means of a return system designed to cooperate with said lifting cable, so as to cause a displacement of said stanchion from its working position to its transport position.

In other words, the invention proposes a tower crane in which the folding movement of the stanchion, from its working position to its transport position, is carried out by using the lifting cable: the tension force exerted on it by the winding device is transmitted to the stanchion via the return system, to thereby move the stanchion.

In the remainder of this description, the term «folding the stanchion» means a movement of said stanchion from its working position to its transport position, the term «unfolding the stanchion» means a movement of said stanchion from its transport position to its working position, the term «folding tower crane» means a movement of said tower crane from its working configuration to its transport configuration, and the term «unfolding the tower crane» means a movement of said tower crane from its transport configuration to its working configuration.

In the tower cranes of the state of the art, the lifting cable usually includes a first portion, extending along the mast, connected to a second portion extending along the boom: by means of the tension force applied by the winding device (which may for example consist of a winch secured to the mast) on this lifting cable, it is possible to vary a length of the latter in order to hoist and displace vertically a load fastened to a block, itself connected to said lifting cable.

The invention therefore proposes to exploit this tension force in another manner, by applying it, by means of the return system, to an area of the stanchion in order to cause the folding of said stanchion.

It should be noted that, in a tower crane according to the invention, the lifting cable retains its load lifting function: the use of the lifting cable for folding the stanchion during the passage of the tower crane from its working configuration to its transport configuration is thus an additional feature which does not change the normal operation of the tower crane when the latter is in its working configuration.

It will be noted that, as will be further described later, the unfolding of the stanchion can, for its part, be carried out by means of a rear retainer, composed of hinged connecting rods or a cable extending along the mast and connecting the stanchion to the frame supporting the same mast: during the passage of the tower crane according to the invention from its transport configuration to its working configuration, the rear retainer exerts, on the stanchion, a force causing the latter to move automatically from its transport position to its working position.

Thus, while the folding movement of the stanchion requires the use of the tension force exerted on the lifting cable, this tension force is not essential for the unfolding movement of the same stanchion.

However, it remains possible that the unfolding movement of the stanchion is carried out, in the same manner as the folding movement, by means of the application of this tension force on the stanchion.

In particular, the invention intends to combine simultaneous actions on the stanchion of the tension force of the lifting cable and the rear retainer during the unfolding of the tower crane, so as to monitor the unfolding speed of the stanchion.

A more accurate description of such a method for unfolding the stanchion can be found below.

According to one possibility, the return system includes at least one main return element in which the lifting cable is designed to be engaged, said main return element being provided to be fastened on the stanchion.

The lifting cable of a tower crane according to the invention thus includes an intermediate portion connecting the first portion and the second portion of the latter, this intermediate portion cooperating with the return system in the vicinity of the stanchion and the main axis of rotation hinging the boom and the mast.

In particular, the lifting cable is engaged in a main return element secured to the stanchion: the tension force exerted on the lifting cable by the winding device is thus transmitted to this main return element, which in turn transmits at least one portion of this tension force to the stanchion.

Under the effect of this force exerted by the main return element on the stanchion, hereinafter referred to as «folding force», the stanchion is displaced from its working position to its transport position.

In a variant, the main return element is a pulley including a wheel cooperating with the lifting cable and a yoke, carrying said wheel and fastened on the stanchion.

Advantageously, the stanchion is designed to be connected in rotation, about a secondary axis of rotation, to a first boom segment extending in an arrow direction, said stanchion being provided to be displaceable, between its working position and its transport position, by a rotational movement relative to the first boom segment about said secondary axis of rotation.

In this manner, it is sufficient to configure the return system so that the folding force exerts on the stanchion a mechanical moment directed along this secondary axis of rotation, in order to displace the stanchion towards its transport position.

According to one feature, the secondary axis of rotation is parallel to the main axis of rotation.

According to one possibility, the stanchion has a stanchion body extending in a stanchion direction between a first end, designed to be connected to the first boom segment, and an opposite second end, the main return element of the return system being disposed in the vicinity of said second end.

The tension force of the lifting cable is thus applied on the stanchion at a maximum distance from the secondary axis of rotation, so as to increase as much as possible the lever arm exerted on the stanchion by the folding force transmitted by the main return element.

Thus, the folding movement of the stanchion can be carried out without the tension force needing to have an excessively high intensity for this.

In one embodiment, the stanchion direction is parallel to the arrow direction when said stanchion is in its working position, and the stanchion direction is orthogonal to the arrow direction when said stanchion is in its transport position.

It is thus understood, within the meaning of the invention, that the stanchion extends in a stanchion direction substantially parallel to the arrow direction in its working position, and substantially orthogonal to this same arrow direction in its transport position.

In other words, the invention considers embodiments in which the stanchion direction forms with the arrow direction an angle whose measurement is comprised between −20° and 20° when the stanchion is in its working position, and an angle whose measurement is comprised between 70° and 110° when the stanchion is in its working position.

Thus, the folding movement of the stanchion consists in making the latter perform a rotational movement of about 90° about the secondary axis of rotation.

As will be more clearly described later, when the folding of the stanchion is performed while the mast direction is substantially horizontal (that is to say perpendicular to the direction of the earth's gravity), this rotational movement tends to oppose the weight of the stanchion and the rear retainer which is connected thereto: the tension force exerted on the lifting cable should then have a sufficiently significant intensity to compensate for the force of gravity and displace the stanchion towards its transport position.

For example, the stanchion may be formed by two chords, joined at one of the ends thereof and forming with the secondary axis of rotation an isosceles triangle, substantially parallel to the arrow direction when the stanchion is in its working configuration.

The main return element can then be disposed at this junction point between the two chords.

It will be noted that this junction point can also be connected to an upper chord of the first boom segment by a line of upper tie rods allowing transmitting, to said first boom segment, the efforts exerted on the stanchion by the rear retainer so as to cause a movement of rotation of said first boom segment relative to the mast: this line of upper tie-rods thus forms, with the two chords and the secondary axis of rotation, the general trihedron shape.

According to one possibility, the first boom segment has at least one upper chord and one lower chord defining respectively, in a direction perpendicular to the arrow direction, an upper limit and a lower limit of said first boom segment, where the secondary axis of rotation is provided to be positioned at said lower limit, and in which the return system includes at least one secondary return element provided to be positioned in the vicinity of said upper limit, the lifting cable being designed to be engaged successively in said secondary return element then in the main return element, such that the tension force generates, on said main return element, a folding force directed towards said secondary return element and allowing a displacement of said stanchion from its working position towards its transport position.

This particular configuration of the return system ensures that the tension force exerted by the lifting cable on the main return element (secured to the stanchion) has a direction allowing displacing the stanchion towards its transport position.

Indeed, by positioning a secondary return element at the upper limit of the first boom segment while the secondary axis of rotation is disposed in the vicinity of the lower limit thereof, the tension force exerted by the lifting cable on the main return element is directed towards this upper limit and therefore tends to bring the main return element closer to this same upper limit.

In other words, the tension force transmitted to the stanchion via the main return element has an oblique direction, directed «upwardly», relative to the arrow direction and allows rotating this stanchion about the secondary axis of rotation.

It should also be noted that the main axis of rotation is, for its part, comprised between the upper limit and the lower limit of the first boom segment.

Advantageously, the secondary return element is provided to be fastened on the mast and connected to the winding device by a first portion of the lifting cable provided to extend along said mast, where said secondary return element and the main return element are provided to be positioned, in the arrow direction, on either side of the secondary axis of rotation when the stanchion is in its working position.

In other words, the first portion of the lifting cable, extending along the mast, is directly engaged in the secondary return element secured to the mast, then this same lifting cable is engaged in the main return element secured to the stanchion.

The tracking system therefore does not include, in this embodiment, any other return element in which the lifting cable is engaged between the main return element and the secondary return element.

This feature, combined with the fact that the secondary return element is disposed, in the arrow direction, opposite to the main return element relative to the secondary return axis (about which the stanchion is hinged) allows maximizing the lever arm exerted on the stanchion and therefore minimizing the intensity of the tension force necessary to move the latter towards its transport position.

According to one possibility, the return system includes one or several tertiary return element(s) provided to be fastened on the mast, the stanchion or the first boom segment, the lifting cable being designed to be engaged in said tertiary return elements, so as to transmit the tension force of the main return element to a second portion of the lifting cable, said second portion being provided to extend along the first boom segment.

The lifting cable is therefore successively engaged in the secondary return element, then in the main return element, then in the tertiary return element(s).

It should be noted that embodiments, in which the lifting cable is engaged in additional return elements before being engaged in the secondary return element, are also possible.

The positioning of these different return elements is adapted to:

allow exerting, on the stanchion, a tension force directed from the main return element towards the secondary return element, in order to cause a displacement of the stanchion towards its transport position, and transmit, thanks to the tertiary return elements, this tension force to the second portion of the lifting cable, extending along the first boom segment.

In particular, it is particularly advantageous that the lifting cable is engaged, at the output of the main return element, in a tertiary return element fastened on the first boom segment and positioned in the vicinity of the upper limit of the same first boom segment, so that the tension force exerted by the lifting cable on the main return element results in the application of a lifting force of a significant intensity on the stanchion.

Advantageously, the main, secondary and tertiary return elements are positioned so as to transmit the tension force from the first portion of the lifting cable to the second portion of the lifting cable without applying efforts for deforming this same lifting cable in torsion.

For example, this can be carried out by aligning two by two the return directions of two successive return elements.

This features is particularly important in the embodiments in which the tower crane according to the invention includes a boom offset relative to the mast, that is to say in the case where the first boom segment is offset relative to the mast in a transverse direction, orthogonal to both the arrow direction and an extension direction of the mast.

In these embodiments, the return system should be configured to transmit the tension force along the lifting cable also in this transverse direction, which can potentially cause the appearance of significant torsional efforts of the lifting cable and lead to its rupture.

In one embodiment, the winding device includes an actuator adapted to vary an intensity of the tension force exerted on the lifting cable by said winding device.

By controlling the intensity of the tension force, it is thus possible to monitor, by means of the winding device, the intensity of the folding force exerted on the stanchion by the main return element, and therefore the kinematics of the folding (or unfolding) movement of the stanchion.

In particular, it is possible to adjust the folding (or unfolding) speed of the stanchion by decreasing or increasing the intensity of the tension force in the lifting cable.

According to one possibility, the lifting cable extends between a first end provided to be fastened to the boom and a second end provided to be connected to the winding device, said winding device being secured to the mast, and in which the actuator of the winding device is adapted to vary a cable length of said lifting cable measured between said first end and said winding device, so as to vary the intensity of the tension force.

The winding device therefore allows increasing the intensity of the tension force exerted on the lifting cable by shortening the cable length, or decreasing this intensity by increasing this cable length.

It is thus possible to monitor the kinematics of the stanchion by unwinding or winding the lifting cable in the winding device, which makes the control of the folding and unfolding movements of the stanchion particularly simple.

In one embodiment, the winding device includes a monitoring system adapted to:

determine a value of a characteristic quantity representative of the intensity of the tension force, compare said value to a previously defined threshold value, and drive the actuator of said winding device so as to increase the cable length when said value is greater than said threshold value, and drive the actuator of said winding device so as to decrease the cable length when said value is less than said threshold value.

According to one possibility, the monitoring system is adapted to determine the value of the characteristic quantity representative of the intensity of the tension force by means of at least the one of the following measurements:

a direct measurement of said intensity of the tension force by means of a dynamometer, a measurement of an intensity of an electric current supplying the actuator of the winding device with electricity, or a measurement of a torque or a mechanical force internal to said actuator For example, when the winding device is a winch actuated by a motor, the characteristic quantity may correspond to an intensity of the current for supplying this motor, or else a value of a resistive torque being exerted on the motor shaft of the latter.

These characteristic quantities undergo the same time variations as the intensity of the tension force and are thus representative of the value of this intensity of the tension force: they therefore allow an indirect regulation of the intensity of the tension force without the need for directly measuring the latter.

Such a monitoring system thus allows maintaining, permanently and automatically, the value of the intensity of the tension force approximately constant, throughout the folding or the unfolding of the tower crane according to the invention, and in particular throughout the folding or the unfolding of the stanchion.

Indeed, during the folding or unfolding of the different elements of the tower crane (for example, folding or unfolding of the stanchion, rotation of the boom relative to the mast or even stacking of the different segments composing the boom or the mast as appropriate), the length traveled by the lifting cable between the first end thereof (fastened on the boom) and the second end thereof (connected to the winding device, secured to the mast) is caused to vary.

For example, when unfolding the crane, the cable length tends to increase until the tower crane has reached its working configuration, this increase in cable length resulting in an increase in the intensity of the tension force in the lifting cable: this increase, in turn, results in a corresponding increase in the value of a characteristic quantity representative of the intensity of the tension force.

As soon as this value reaches the threshold value, the winding device (driven by the monitoring system) unwinds a predefined length of a lifting cable, in order to slightly lower this value (and therefore, in an equivalent manner, to lower the intensity of the tension force in the lifting cable).

After a short time, this same value of the characteristic quantity reaches the threshold value and the winding device unwinds again the lifting cable, etc.

Thus, throughout the unfolding of the tower crane (and in particular during the unfolding of the stanchion), the value of the characteristic quantity oscillates around the threshold value, the winding device unwinding the lifting cable in stages: the intensity tension force is therefore also kept approximately constant during the unfolding of the tower crane.

The monitoring system operates in a similar manner during the folding of the tower crane (and in particular during the folding the stanchion), the winding device winding the lifting cable in stages.

The monitoring system therefore allows automatically monitoring the kinetics of the folding and unfolding movements of the tower crane or the stanchion, by the indirect (or direct according to the embodiment) monitoring of the value of the intensity of the tension force.

In particular, the threshold value is advantageously chosen so that it is:

sufficiently high, so that the tension force in the lifting cable can be sufficiently significant to cause the displacement of the stanchion towards its transport position, and sufficiently low, so as not to block the movement of the different hinges of the tower crane (a too significant tension could lead to deformation or deformation of the various components of the tower crane).

It should also be noted that the tension force exerted in the lifting cable 5 must be sufficiently significant at all times to keep the block against the boom, in order to avoid a deterioration of the tower crane during the folding or unfolding methods.

The invention also concerns a method for unfolding and folding a tower crane as previously described, including:

an unfolding phase, during which said tower crane passes from its transport configuration to its working configuration, and during which the stanchion is displaced from its transport position to its working configuration under the action of a rear retainer designed to connect said stanchion to a frame supporting the mast, and a folding phase during which said tower crane passes from its working configuration to its transport configuration, and during which the stanchion is displaced from its working position to its transport configuration under the effect the tension force exerted by the winding device on the lifting cable.

According to one possibility, the tension force generates on the stanchion, during the folding phase, a folding force causing a displacement of said stanchion from its working position to its transport position, said folding force being such as to oppose, in the vertical direction, the weight of said stanchion under the effect of the earth's gravity, a folding force causing a displacement of said stanchion from its working position to its transport position, said folding force having a vertical component opposite to the force of the earth's gravity.

It is in fact conceivable that the folding movement of the stanchion is indeed carried out while the arrow direction is horizontal, that is to say perpendicular to the direction the earth's gravity.

In this case, the folding movement of the stanchion, consisting for example of a rotational movement «upwardly» about the secondary axis of rotation tends to oppose the weight of said stanchion: it is thus necessary that the tension force is applied on the stanchion so as to generate a folding force directed opposite to the earth's gravity and allowing compensating in particular for the weight of the stanchion and of the rear retainer, in order to be able to «lift» the latter and displace it towards its transport position.

Advantageously, the tower crane is as previously described, the folding phase including a step of driving the actuator of the winding device by the monitoring system so as to decrease the cable length so as to cause the displacement of the stanchion towards its transport configuration.

This step of reducing the cable length results in an increase in the tension force in the lifting cable, then in an increase in the folding force exerted on the stanchion, and finally in a displacement of the stanchion towards its transport position under the effect of this folding force.

As previously mentioned, it is then advantageous to select a threshold value of the monitoring system which is sufficiently high, so that the tension force in the lifting cable can be sufficiently significant to cause the displacement of the stanchion towards its transport position, opposing its own weight and that of the rear retainer.

According to one possibility, the unfolding phase includes at least one step during which the monitoring system compares the value of the characteristic quantity representative of the intensity of the tension force to a threshold unfolding value, and where the folding phase includes at least one step during which the monitoring system compares the value of the characteristic quantity representative of the intensity of the tension force to a folding threshold value, said folding threshold value being greater than said unfolding threshold value.

The selection of two different (folding and unfolding) threshold values allows the monitoring system to drive the folding and unfolding movements of the stanchion, in an appropriate manner.

Indeed, as previously described, the tension force exerted in the lifting cable results in the application of a folding force on the stanchion tending to oppose the weight of said stanchion and the rear retainer.

During a folding movement of the stanchion, it is necessary that this folding force is sufficiently significant to overcome this weight and displace the stanchion towards its transport position against the earth's gravity.

During an unfolding movement, the stanchion is displaced towards its working position under the effect of its own weight, and the folding force then has the role of partially compensating for this weight to slow down the kinetics of the folding movement and monitor the unfolding speed of the stanchion: the folding force should therefore not be as significant as during a folding movement.

Thus, in an equivalent manner, the tension force must have a lower intensity during the unfolding movements than during the folding movements of the stanchion: this feature then results in a selection of a folding threshold value greater than an unfolding threshold value.

For example, the folding threshold value is at least 20% greater than the unfolding threshold value.

It is also possible that the folding and/or unfolding methods can be carried out, at least partially, by a human operator, said operator being able, in particular, to drive the winding device so as to vary the intensity of the tension force in the lifting cable.

In particular, it is advantageous that such a human operator can choose to trigger a folding or unfolding movement of the stanchion at any time during a method for folding or unfolding the tower crane according to the invention.

For example, if the tower crane should be unfolded in the vicinity of a building or an outer element likely to hinder the automatic unfolding movement of the stanchion, the operator can choose to perform this unfolding of the stanchion at a time of the method for unfolding the tower crane where the stanchion is the farthest from said building or outer element.

BRIEF DESCRIPTION OF THE DRAWINGS

Other features and advantages of the present invention will appear on reading the detailed description below, of several non-limiting examples of implementation, made with reference to the appended figures in which:

[FIG. 1] is a view of a tower crane according to the invention in its working configuration;

[FIG. 2] is a perspective detail view of a stanchion of a tower crane according to the invention;

[FIG. 3] is a side view of a stanchion of a tower crane according to the invention;

[FIG. 4] is a detail view of the return system of a tower crane according to the invention;

[FIG. 5] is a view of a tower crane according to the invention in a first intermediate configuration, during a method for folding said tower crane;

[FIG. 6] is a view of a tower crane according to the invention in a second intermediate configuration, during the method for folding said tower crane;

[FIG. 7] is a detail view of a stanchion of a tower crane according to the invention in its working position;

[FIG. 8] is a detail view of a stanchion of a tower crane according to the invention in an intermediate position, during a method for folding said stanchion;

[FIG. 9] is a detail view of a stanchion of a tower crane according to the invention in its transport position; and [FIG. 10] is a view of a tower crane according to the invention in its transport configuration.

DESCRIPTION

FIG. 1 represents a tower crane 1 according to the invention, in the working configuration.

This tower crane 1 includes a boom 2 having a first boom segment 21, a second boom segment 22 and a third boom segment 23, hinged in pairs in rotation about a first axis of rotation of boom 221 and a second axis of rotation of boom 231.

The tower crane 1 also includes a mast 3 having, for its part, a first mast segment 31 and a second mast segment 32, hinged in rotation relative to each other about an axis of rotation of mast 321.

This mast is supported by a frame 4, intended to rest on the ground, the second mast segment 32 being hinged in rotation relative to the frame 4 about an axis of rotation of frame 41.

The first boom segment 21 extends between a first end 211 and a second end 214 in a direction of arrow F, which may also be referred to as a boom length direction or a longitudinal direction of the boom or boom segment, and the first mast segment 31 extends in a direction of mast M.

The first boom segment 21 and the first mast segment are moreover hinged in rotation relative to each other about a main axis of rotation 311.

It should be noted that the first axis of rotation of boom 221, the second axis of rotation of boom 231, the axis of rotation of mast 321 and the axis of rotation of frame 41 are parallel relative to each other and also parallel to the main axis of rotation 311.

This tower crane 1 can thus be folded and unfolded between:

a working configuration (illustrated in FIG. 1), in which the first mast segment 31 and the second mast segment 32 extend in the same direction of mast M, this direction of mast M being vertical with respect to the ground on which the frame 4 is disposed (that is to say that the direction of mast M substantially coincides with the direction of the earth's gravity G), and in which the first boom segment 21, the second boom segment 22 and the third boom segment 23 all extend in the same direction of arrow F, i.e., the boom length direction, this direction of arrow F then being substantially perpendicular relative to the direction of mast M (and is then called «horizontal», and a transport configuration (illustrated in FIG. 10), in which the first mast segment 31 and the second mast segment 32 are stacked one on top of the other, and the first boom segment 21, the second boom segment 22 and the third boom segment 23 are also stacked on top of each other, the direction of arrow F and the direction of mast M then being substantially parallel and horizontal.

In its transport configuration, the tower crane 1 has a very compact shape and is then very easily transportable.

In its working configuration, the tower crane 1 is adapted to displace a load fastened to a hook C, itself connected to a block O designed to be displaceable along the boom 2.

The block O is also connected to a lifting cable 5 including a first end 51 fastened on the third boom segment 23 and a second end 52 connected to a winding device 53 secured to the second mast segment 32.

This winding device 53 (for example, consisting of a winch actuated by a motor) is designed to alternately increase or decrease a cable length of the lifting cable 5, which is measured between the first end 51 and the second end 52, (for example, by winding or unwinding said lifting cable 5), in order to respectively raise or lower the block O in the direction of mast M, and thus displace a load fastened to the hook C in the vertical direction when the tower crane 1 is in the working configuration.

Thus, by increasing or decreasing the cable length of the lifting cable 5, the winding device 53 is therefore adapted to exert a tension force T of varying intensity on this same lifting cable 5.

The tower crane 1 also includes a stanchion 6, hinged in rotation with the first end 211 of the first boom segment 21 about a secondary axis of rotation 61, and extending the boom 2 beyond the main axis of rotation 311.

This stanchion 6 is also connected to a rear retainer 7, formed of several connecting rods 71, 72, 73 and 74 hinged to each other and connecting the stanchion 6 to the frame 4 by extending along the mast 2.

In the working configuration of the tower crane 1, this rear retainer 7 allows, via the stanchion 6, maintaining the boom 2 in its horizontal position at the top of the mast 2.

The following FIGS. 2 to 4 attempt to describe the geometry and the particular structure of the stanchion 6 and of the lifting cable 5.

As shown in FIGS. 2 and 3, the stanchion 6 includes in particular two chords 62 hinged in rotation with the first boom segment 21 about the secondary axis of rotation 61 and joined at a junction point 63.

In particular, these chords 62 are thus displaceable relative to the first boom segment 21 between a working position of the stanchion 6 (as illustrated in FIGS. 2 to 7) and a transport position (as illustrated in FIG. 9).

As shown in these FIGS. 2 and 3, in the working position of the stanchion 6, the chords 62 define a plane parallel to the direction of arrow F.

As visible in FIG. 9, in the working position of the stanchion 6, the chords 62 define a plane which is substantially perpendicular to the direction of arrow F.

In its transport position, the stanchion 6 is in abutment against the first boom segment 6, thereby improving the overall compactness of the tower crane 1 in its transport configuration.

In the remainder of this description, it will be said that the stanchion 6 follows a folding movement when it is displaced from its working position towards its transport position, and an unfolding movement when it is displaced from its transport position towards its working position.

As previously mentioned, the stanchion 6 is connected, at the junction point 63 to the rear retainer 7: the junction point being located at a maximum distance from the main axis of rotation 311, this feature allows increasing the lever arm of the efforts exerted on the stanchion by the rear retainer 7.

Thus, it is possible to drive the boom 2 in rotation about the main axis of rotation 311 by means of a minimum effort of the retainer 7 (in particular during the phases of folding and unfolding the tower crane 1, as described below).

Moreover, it should be noted that the secondary axis of rotation 61 is positioned at a lower limit of the first boom segment 21 defined by lower boom chords 212.

The tower crane 1 also includes a line of upper tie rods 64 joining the junction point 63 of the stanchion 6 to the first boom segment 21, at an upper limit of said first boom segment 21 defined by upper boom chords 213.

It will also be noted that, as shown in particular in FIG. 3, the boom 2 is offset relative to the mast 3 in a transverse direction 33, orthogonal to the direction of mast M and to the direction of arrow F: this feature allows further increasing the compactness of the tower crane 1 when the latter is in its transport configuration.

Consequently, the stanchion 6 extends obliquely with respect to the direction of arrow F, the junction point 63 being located (in the transverse direction 33) at the mast 3, while the hinge of the chords 62 with the first boom segment 21 is located at said first boom segment.

Of course, other embodiments concerning the geometry and the relative positioning of the stanchion 6, of the first mast segment 31 and the first boom segment 21 can be considered.

As shown in FIGS. 2 to 4, the stanchion cooperates with the lifting cable 5 via a return system 8.

The return system 8 allows transmitting the tension force T exerted on the lifting cable 5 by the winding device 53 between a first portion 54 of the lifting cable 5, extending along the mast 3, and a second portion 55 of the lifting cable 5, extending along the boom 2.

This return system 8 therefore cooperates with an intermediate portion 56 of the lifting cable, said intermediate portion 56 joining said first portion 54 and second portion 55.

In particular, by raising the lifting cable 5 from its second end 52 (fastened to the winding device 53 «at the bottom» of the mast) towards its first end 51 (fastened to the boom 2), the lifting cable 5 is successively engaged in:

a secondary return element 81, formed of two pulleys 811 fastened on the first mast segment 31 at the upper limit of the first boom segment 21;

a main return element 82, formed of a pulley fastened on the stanchion 6 at the junction point 63; then four tertiary return elements 83, each formed of a pulley fastened alternately on the stanchion 6, the first boom segment 21 or the first mast segment 31.

Thus, the return system 8 is well adapted to transmit the tension force T between the first portion 54 and the second portion 55 of the lifting cable 5.

It should be noted that the pulleys of the secondary return element 81, of the main return element 82 and the tertiary return elements 83 are advantageously disposed so as not to introduce torsional efforts into the lifting cable 5.

Indeed, the return directions of the latter are aligned two by two, such that no angle is generated between the cable 5 and each of the pulleys in which it is engaged.

As previously, many other embodiments can be considered concerning this return system 8, whose structure is necessarily adapted to that of the tower crane 1.

It is necessary, for reasons which will be described later, for this return system 8 to cooperate with the stanchion 6; in particular, it is necessary for the return system 8 to be configured to be able to transmit the tension force T, exerted on the lifting cable 5, to the stanchion 6.

FIGS. 5 to 10 describe the different steps of a method for folding the tower crane 1 according to the invention, that is to say a method allowing shifting the latter from its transport configuration to its working configuration.

This folding method begins with a step of folding the boom 2 on itself, by stacking (shown in FIG. 5) of the first boom segment 21, second boom segment 22 and third boom segment 23, by rotating about a first axis of rotation of boom 221 and of the second axis of rotation of boom 231.

The mast is then also folded on itself, by a rotational movement of the first mast segment 31 about the axis of rotation of mast 321 and of the second mast segment 32 about the axis of rotation of frame 41.

These rotational movements of the first mast segment 31 and the second mast segment 32 are carried out by means of a telescopic cylinder V, allowing exerting on them mechanical efforts tending to bring them closer or to move them away from each other.

The rear retainer 7 being moreover connected in a hinged manner to the frame 4 (by means of a connecting rod 71, said connecting rod 71 also being telescopic) to the stanchion 6 (by means of a connecting rod 72), to the first mast segment 31 (by means of a connecting rod 73) and to the second mast segment 32 (by means of a connecting rod 74), this rear retainer is deformed under the effect of the folding movement of the mast 2: under the effect of the action of the cylinder V, the rear retainer allows monitoring the folding kinetics of the tower crane 1.

In particular, during the folding of the mast 2 on itself, the forces exerted by the rear retainer 7 on the stanchion 6 decrease, causing a rocking movement of the boom 2 about the main axis of rotation 311: the boom 2 (itself already folded on itself) approaches the first mast segment 31 and the measurement of the angle between the direction of arrow F and the direction of mast M decreases.

As shown in FIG. 6, at the end of this step of rocking the boom 2, the latter is positioned against the first mast segment 31 and the direction of arrow F and the direction of mast M are substantially collinear.

Until then, the position of the stanchion 6 relative to the first boom segment 21 has not been changed: the stanchion 6 has remained in its working position, in which the chords 62 are substantially parallel to the direction of arrow F.

Moreover, these steps of folding the boom 2 and the mast 3 cause the lifting cable 5 to loosen: during all previous steps, the winding device 53 has been driven, by means of a monitoring system whose operation will be described in more detail below, so as to reduce the cable length of the lifting cable 5, in order to compensate for the loosening of the lifting cable 5 and thus maintain a tension force in the lifting cable 5 of a relatively constant intensity.

Once the configuration represented in FIG. 6 has been reached, the winding device 53 continues to be driven by the monitoring system so as to wind the lifting cable 5 (that is to say so as to decrease the cable length).

Under the effect of the winding device 53, the lifting cable 5 exerts on the main return element 82 of the return system a tension force T directed towards the secondary return element 81.

Due to the configuration of the return system 8, and in particular the relative positioning of the main return element 82, the secondary return element 81 and of the identified tertiary return element 83' in this FIG. 7, the application of this tension force T on the main return element 82 results in the application of a folding force P on the stanchion 6, at the junction point 63.

This folding force P has an intensity which depends in particular on the relative positioning of the main return element 82, the secondary return element 81 and of the tertiary return element 83' (in particular, a positioning of the tertiary return element 83' in the vicinity of the upper limit of the first boom segment 21 allows maximizing the intensity of the folding force P), and on the mechanical friction exerted by these same return elements 81, 82 and 83' on the lifting cable 5.

The folding force P thus exerts on the stanchion 6 a folding moment allowing driving the stanchion 6 in rotation with respect to the first boom segment 21 about the secondary axis of rotation 61.

As shown in FIGS. 8 and 9, the stanchion 6 is thus displaced from its working position (in FIG. 7) towards its transport position (in FIG. 9) under the effect of the tension force T and the folding force P.

It is important to note the positioning of the secondary return element 82, disposed in the vicinity of the upper limit of the first boom segment 21 (defined by the upper boom chords 213), relative to the secondary axis of rotation, disposed in the vicinity of the lower limit of the first boom segment 21 (defined by the lower boom chords 212), and relative to the main return member 82, disposed between said upper limit and said lower limit.

Thanks to this positioning, the folding force P tends to bring the junction point 63 closer to this upper limit, that is to say, it tends to «lift» the stanchion 6 relative to the direction of arrow F.

This direction of arrow F being, during the folding movement of the stanchion 6, substantially horizontal (as shown in FIG. 6), the folding force P is therefore opposed to the earth's gravity G: the folding movement of the stanchion is thus performed against the weight PO of the stanchion 6 and the rear retainer 7.

It is therefore necessary for the tension force T to have a sufficient intensity for the folding force P to be significant enough to compensate for and overcome the weight PO tending to maintain the stanchion 6 in its working position.

It will also be noted that the application of the folding force P at the junction point 63 allows maximizing the lever arm of this folding force P: it is thus possible to move the stanchion 6 by means of a tension force T of a moderate intensity.

FIG. 8 illustrates an intermediate position of the stanchion 6, between its working position and its transport position, during its rotational movement about the secondary axis 61 under the effect of the tension force T.

FIG. 9 illustrates this same stanchion 6 after it has reached its transport position: the stanchion 6 is then positioned in abutment against the first end 211 of the first boom segment 21, and the chords 62 are then substantially orthogonal to the direction of arrow F.

Once the stanchion 6 is in its transport position, the folding of the mast 3 is completed under the effect of the cylinder V and the tower crane 1 is then in its transport configuration, illustrated in FIG. 10.

In this transport configuration, the first mast segment 31 and the second mast segment 32 are folded over each another and both extend horizontally.

Likewise, the boom 2 is folded back on itself in contact with the first mast segment 31 and also extends horizontally.

Thus, the tower crane is in a very compact form and occupies a small volume, which makes it easily transportable by conventional means of transport.

It should be noted that the fact of having displaced the stanchion 6 towards its transport position, in abutment against the first boom segment 21, allows reducing the space requirement of the tower crane 1 in its transport configuration: the folding of the stanchion 6 allows reducing a length L occupied by the tower crane 1 by a length L' of the chords 62 (measured between the junction point 63 and the secondary axis of rotation 61.

As previously mentioned, the tower crane 1 includes a monitoring system allowing driving the winding device 53 so as to control the intensity of the tension force T in the lifting cable 5 during the folding movement of the stanchion 6.

More specifically, this monitoring system is capable of measuring a value of a characteristic quantity representative of the intensity of the tension force T, undergoing the same variations over time as the intensity of the tension force.

For example, when the winding device is a winch actuated by a motor, the characteristic quantity may correspond to an intensity of the current for supplying this motor, or else a value of a resistive torque exerted on the motor shaft of the latter.

This characteristic quantity can also correspond to the intensity of the tensile force T itself, for example measured by means of a dynamometer.

The monitoring system is designed to regularly compare the value of this characteristic quantity with a pre-defined threshold value and to command the winding device 53 to increase the cable length when the value of this characteristic quantity is greater than this threshold value, and command the winding device 53 to decrease the length of the cable when the value of this characteristic quantity is less than this threshold value.

It should be noted that an increase in the cable length automatically results in an increase in the intensity of the tension force T in the lifting cable 5, then in an increase in the value of the characteristic quantity.

Conversely, a decrease in the cable length automatically results in a decrease in the intensity of the tension force T in the lifting cable 5, and then in a decrease in the value of the characteristic quantity.

In this manner, the monitoring system allows automatically and continuously maintaining the value of the characteristic quantity approximately equal to the threshold value throughout the folding or unfolding movements of the tower crane 1, and therefore exerting, on the lifting cable 5, a tension force T of a substantially constant intensity.

Consequently, thanks to the choice of the threshold value of the monitoring system, it is possible to monitor the intensity of the folding force exerted on the stanchion 6 and thus to control the kinematics of the displacements thereof.

In particular, during the method for folding the tower crane 1 which are previously described, the stacking of the boom segments 21, 22 and 23 and the mast segments 31 and 32 tends to release the lifting cable 5 and to decrease the intensity of the tension force T.

Consequently, the winding device 53 performs a regular winding of the lifting cable 5 in order to keep the intensity of the tension force T at a high level.

In fact, as shown in FIGS. 7 to 9, the movement of the stanchion 6 towards its transport position is carried out against the force of the earth's gravity: the tension force T must therefore have a sufficiently significant intensity for the folding force P to be able to overcome the weight of the stanchion 6 and the rear retainer 7, in order to cause the folding movement of the stanchion 6.

It is therefore necessary to choose for the threshold value of the monitoring system a sufficiently high value to be able to carry out a folding of the stanchion.

A method for unfolding the tower crane 1, allowing the latter to pass from its transport configuration to its working configuration, can be carried out in a manner similar to the previously described folding method.

This unfolding method can thus be described by the same FIGS. 5 to 10, navigated in the direction opposite to the folding method, that is to say the unfolding method begins with the transport configuration of the tower crane 1 illustrated in FIG. 10 and ends with the working configuration of tower crane 1 illustrated in FIG. 5.

During this method for unfolding the tower crane 1, the mast is deployed by means of the cylinder V, driven so as to increase the distance separating the first mast segment 31 from the second mast segment 32.

At the beginning of this unfolding method, the stanchion 6 is in its transport position, in abutment against the first boom segment 21.

During the unfolding of the mast 3, the rear retainer 7 exerts mechanical efforts on the stanchion 6 at the junction point 63, resulting in the application, on the stanchion 6, of a mechanical torque allowing the initiation of an unfolding movement of the stanchion 6, towards its working position.

The stanchion 6 is then subjected to the effects of its own weight, which tends to displace it towards its working position: the movement of unfolding of the stanchion 6 is thus carried out thanks to the rear retainer 7 and the weight of the stanchion 6.

It should be noted that (as shown in particular in FIGS. 7 to 9), during the displacement of the stanchion 6 towards its working position, the lifting cable 5 always exerts, on the main return element 82, a tension force T, resulting in the application, at the junction point 63 of a folding force P opposing the weight PO of the stanchion 6: this folding force P thus allows compensating for the weight of the stanchion 6 and thus to slow down the «fall» of the stanchion 6 towards its working position under the effect of the earth's gravity.

Consequently, the monitoring system of the winding device 53 allows, by continuously monitoring the value of the intensity of the tension force T during the unfolding movement of the stanchion 6, to control the kinematics of said stanchion 6.

In particular, the unfolding of the stanchion 6 results in an increase in the cable length of the lifting cable 5: the monitoring system drives the winding device 53 so that the latter unwinds the lifting cable 5, gradually and in a controlled manner, in order to slow down the movement of the stanchion 6.

Once the stanchion 6 has been unfolded and in its working position, the boom 2 is also driven in rotation (under the effect of the rear retainer 7 and via the stanchion 6) relative to the first mast segment 31 about the main axis of rotation 311 and displaced towards a horizontal position, until the tower crane 1 reaches its working configuration illustrated in FIG. 1, in which the boom 2 is perpendicular to the vertical mast 3.

The invention claimed is:

1. A tower crane configured to fold and unfold between a working configuration and a transport configuration, the tower crane having a boom hinged in rotation relative to a mast about a main axis of rotation, the tower crane comprising:

a rear retainer fastened to a frame supporting the mast and to a stanchion, the stanchion extending the boom rearwardly of the main axis of rotation and configured to be displaceable relative to the boom between a working position and a transport position, wherein the tower crane further includes a lifting cable connected to a winding device configured to exert a tension force on the lifting cable, the tension force applied on the stanchion by a return system configured to cooperate with the lifting cable, so as to cause a displacement of the stanchion from the working position to the transport position.

2. The tower crane according to claim 1, wherein the return system includes at least one main return element in which the lifting cable is configured to be engaged, and the main return element is fastened on the stanchion.

3. The tower crane according to claim 1, wherein the stanchion is configured to be connected in rotation, about a secondary axis of rotation, to a first boom segment extending in a boom length direction, the stanchion displaceable between the working position and the transport position by a rotational movement relative to the first boom segment about the secondary axis of rotation.

4. The tower crane according to claim 3, wherein the stanchion has a stanchion body extending in a stanchion direction between a first end and an opposite second end, wherein the first end is configured to be connected to the first boom segment, and the main return element of the return system is disposed in the vicinity of the second end.

5. The tower crane according to claim 4, wherein the stanchion direction is parallel to the boom length direction when the stanchion is in the working position, and wherein the stanchion direction is orthogonal to the boom length direction when the stanchion is in the transport position.

6. The tower crane according to claim 5, wherein the first boom segment has at least one upper chord and one lower chord defining respectively, in a direction perpendicular to the boom length direction, an upper limit and a lower limit of the first boom segment, where the secondary axis of rotation is positioned at the lower limit, wherein the return system includes at least one secondary return element positioned in the vicinity of the upper limit, and the lifting cable is configured to engage successively in the secondary return element and then in the main return element, such that the tension force generates, on the main return element, a folding force directed towards the secondary return element and allowing a displacement of the stanchion from the working position towards the transport position.

7. The tower crane according to claim 6, wherein the secondary return element is fastened on the mast and connected to the winding device by a first portion of the lifting cable extending along the mast, wherein the secondary return element and the main return element are positioned, in the boom length direction, on either side of the secondary axis of rotation when the stanchion is in the working position.

8. The tower crane according to claim 7, wherein the return system includes one or several tertiary return element(s) fastened on the mast, the stanchion or the first boom segment, the lifting cable configured to engage the tertiary return elements, so as to transmit the tension force of the main return element to a second portion of the lifting cable, the second portion extending along the first boom segment.

9. The tower crane according to claim 1, wherein the winding device includes an actuator configured to vary an intensity of the tension force exerted on the lifting cable by the winding device.

10. The tower crane according to claim 9, wherein the lifting cable extends between a first cable end fastened to the boom and a second cable end connected to the winding device, and the winding device is secured to the mast, and wherein the actuator of the winding device is configured to vary a cable length of the lifting cable measured between the first cable end and the winding device, so as to vary the intensity of the tension force.

11. The tower crane according to claim 10, wherein the winding device includes a monitoring system configured to:

determine a value of a characteristic quantity representative of the intensity of the tension force, compare the value to a previously defined threshold value, drive the actuator of the winding device so as to increase the cable length when the value is greater than the threshold value, and drive the actuator of the winding device so as to decrease the cable length when the value is less than the threshold value.

12. The tower crane according to claim 11, wherein the monitoring system is configured to determine the value of the characteristic quantity representative of the intensity of the tension force by at least the one of the following measurements:

a direct measurement of the intensity of the tension force by a dynamometer, a measurement of an intensity of an electric current supplying the actuator of the winding device with electricity, or a measurement of a torque or a mechanical force internal to the actuator.

13. A method for unfolding and folding a tower crane in accordance with claim 1, the method including:

an unfolding phase, during which the tower crane passes from the transport configuration to the working configuration, and during which the stanchion is displaced from the transport position to the working position under the action of the rear retainer configured to connect the stanchion to the frame supporting the mast, and a folding phase during which the tower crane passes from the working configuration to the transport configuration, and during which the stanchion is displaced from the working position to the transport position under the effect the tension force exerted by the winding device on the lifting cable.

14. The method according to claim 13, wherein, during the folding phase, the tension force generates, on the stanchion, a folding force causing a displacement of the stanchion from the working position to the transport position, the folding force opposing, in the vertical direction, the weight of the stanchion under the effect of gravity.

15. The method according to claim 13, wherein the winding device includes an actuator configured to vary an intensity of the tension force exerted on the lifting cable by the winding device, wherein the lifting cable extends between a first cable end fastened to the boom and a second cable end connected to the winding device, and the winding device is secured to the mast, wherein the actuator of the winding device is configured to vary a cable length of the lifting cable measured between the first cable end and the winding device so as to vary the intensity of the tension force, and wherein the folding phase includes a step of driving the actuator of the winding device so as to decrease the cable length so as to cause the displacement of the stanchion towards the transport configuration.

16. The method according to claim 15, wherein the winding device includes a monitoring system configured to:

determine a value of a characteristic quantity representative of the intensity of the tension force, compare the value to previously defined threshold value, drive the actuator of the winding device so as to increase the cable length when the value is greater than the threshold value, and drive the actuator of the winding device so as to decrease the cable length when the value is less than the threshold value, wherein the unfolding phase includes at least one step during which the monitoring system compares the value of the characteristic quantity representative of the intensity of the tension force to a threshold unfolding value, and wherein the folding phase includes at least one step during which the monitoring system compares the value of the characteristic quantity representative of the intensity of the tension force to a folding threshold value, and wherein the folding threshold value is greater than said unfolding threshold value.

* * * * *